US006763860B2

(12) United States Patent
Jungmann et al.

(10) Patent No.: US 6,763,860 B2
(45) Date of Patent: Jul. 20, 2004

(54) FLOW-BASED CHEMICAL DISPENSE SYSTEM

(75) Inventors: Ronald D. Jungmann, Maplewood, MN (US); Bruce W. Weber, Stillwater, MN (US); James M. Zell, Northfield, MN (US); Clyde A. Bailey, Hastings, MN (US); Jun Wu, Vadnais Heights, MN (US); Gregory B. Laughland, Rochester, MN (US)

(73) Assignee: Ecolab, Inc., Mendota Heights, MN (US)

( * ) Notice: Subject to any disclaimer, the term of this patent is extended or adjusted under 35 U.S.C. 154(b) by 74 days.

(21) Appl. No.: 10/188,714

(22) Filed: Jul. 2, 2002

(65) Prior Publication Data

US 2003/0012081 A1 Jan. 16, 2003

Related U.S. Application Data

(60) Provisional application No. 60/304,587, filed on Jul. 10, 2001, and provisional application No. 60/312,587, filed on Aug. 15, 2001.

(51) Int. Cl.[7] ..... B65B 1/04

(52) U.S. Cl. ..... 141/104; 141/83; 141/94; 141/192; 436/43; 422/105

(58) Field of Search ..... 141/9, 100–104, 141/83, 94, 95, 192, 198; 436/43, 50, 52, 55, 56, 174, 179, 800, 172; 422/67, 68.1, 82, 82.08, 105, 110, 119; 137/341, 625.41, 644.11, 3; 222/144.5, 146.5

(56) References Cited

U.S. PATENT DOCUMENTS

| | | | |
|---|---|---|---|
| 3,743,598 | A | 7/1973 | Field |
| 3,754,871 | A | 8/1973 | Hessel et al. |
| 3,772,193 | A | 11/1973 | Nelli et al. |
| 3,826,113 | A | 7/1974 | Noraas et al. |
| 4,040,515 | A | 8/1977 | Hessel et al. |
| 4,241,400 | A | 12/1980 | Kiefer |
| 4,247,396 | A | 1/1981 | Buesing |
| 4,690,305 | A | 9/1987 | Copeland |
| 4,756,321 | A | 7/1988 | Livingston et al. |

(List continued on next page.)

FOREIGN PATENT DOCUMENTS

| | | |
|---|---|---|
| CA | 1333099 | 11/1994 |
| DE | 2444199 | 3/1975 |

(List continued on next page.)

OTHER PUBLICATIONS

Clover Systems Inc.'s product description of InfAc, 4 pages, including specifications and features, (no date).

*Primary Examiner*—Steven O. Douglas
(74) *Attorney, Agent, or Firm*—Merchant & Gould PC

(57) ABSTRACT

A method and system for formulating and dispensing a chemical product to a dispense location is disclosed. The chemical product is formulated using one or more chemical concentrates. The chemical concentrates may be stored in concentrate containers and provided to a formulator by associated concentrate pumps. The concentrates are pulled from the containers through a manifold and to the formulator. The formulator discharges the chemical concentrates through a dispense hose having an outlet valve to the dispense location. The dispense location may be a jug or a drum. A flow meter connected between the formulator and the dispense hose. The flow meter monitors the component chemical concentrates flowing through the dispense hose and measures volumetric information associated with each component chemical concentrate. A flow controller analyzes the volumetric information generated by the flow meter and controls the volume of each component chemical concentrate dispensed to the dispense location.

33 Claims, 6 Drawing Sheets

U.S. PATENT DOCUMENTS

| | | | | |
|---|---|---|---|---|
| 4,766,548 | A | 8/1988 | Cedrone et al. | 364/479 |
| 4,848,381 | A | 7/1989 | Livingston et al. | |
| 4,858,449 | A | 8/1989 | Lehn | |
| 4,867,196 | A | 9/1989 | Zetena et al. | |
| 4,908,190 | A | 3/1990 | Maglio et al. | |
| 4,964,185 | A | 10/1990 | Lehn | |
| 4,976,137 | A | 12/1990 | Decker et al. | 73/53 |
| 4,999,124 | A | 3/1991 | Copeland | |
| 5,014,211 | A | 5/1991 | Turner et al. | |
| 5,038,807 | A | 8/1991 | Bailey et al. | |
| 5,053,206 | A | 10/1991 | Maglio et al. | |
| 5,203,366 | A | 4/1993 | Czeck et al. | 137/3 |
| 5,240,326 | A | 8/1993 | Evanson | |
| 5,268,153 | A | 12/1993 | Muller | |
| 5,279,448 | A | 1/1994 | Hanlin et al. | |
| 5,322,571 | A | 6/1994 | Plummer et al. | |
| 5,332,312 | A | 7/1994 | Evanson | |
| 5,370,267 | A | 12/1994 | Schroeder | |
| 5,389,344 | A | 2/1995 | Copeland et al. | |
| 5,397,028 | A | 3/1995 | Jesadanont | |
| 5,404,893 | A | 4/1995 | Brady et al. | |
| 5,411,716 | A | 5/1995 | Thomas et al. | |
| 5,427,748 | A | 6/1995 | Wiedrich et al. | |
| 5,497,914 | A | 3/1996 | Maltsis | |
| 5,505,915 | A | 4/1996 | Copeland et al. | |
| 5,556,478 | A | 9/1996 | Brady et al. | |
| 5,580,448 | A | 12/1996 | Brandreth | |
| 5,584,079 | A | 12/1996 | Wong et al. | |
| 5,609,417 | A | 3/1997 | Otte | |
| 5,625,659 | A | 4/1997 | Sears | |
| 5,625,908 | A | 5/1997 | Shaw | |
| 5,679,173 | A | 10/1997 | Hartman | |
| 5,762,096 | A | 6/1998 | Mirabile | |
| 5,769,536 | A | 6/1998 | Kotylak | |
| 5,827,486 | A | 10/1998 | Crossdale | |
| 5,851,291 | A | 12/1998 | Poterala et al. | |
| 5,875,430 | A | 2/1999 | Koether | |
| 5,887,975 | A | 3/1999 | Mordaunt et al. | 366/152.1 |
| 5,897,671 | A | 4/1999 | Newman et al. | |
| 5,902,749 | A | 5/1999 | Lichtwardt et al. | |
| 5,945,910 | A | 8/1999 | Gorra | |
| 5,974,345 | A | 10/1999 | Buck et al. | |
| 6,029,286 | A | 2/2000 | Funk | |
| 6,082,149 | A | 7/2000 | Woods | |
| 6,120,175 | A | 9/2000 | Tewell | |
| 6,133,555 | A | 10/2000 | Brenn | |
| 6,136,184 | A | 10/2000 | King | |
| 6,356,205 | B1 | 3/2002 | Salvo et al. | |
| 2001/0039501 | A1 | 11/2001 | Crevel et al. | |
| 2001/0047214 | A1 | 11/2001 | Cocking et al. | |
| 2001/0053939 | A1 | 12/2001 | Crevel et al. | |
| 2001/0054038 | A1 | 12/2001 | Crevel et al. | |

FOREIGN PATENT DOCUMENTS

| | | |
|---|---|---|
| DE | 19633713 | 2/1988 |
| DE | 283081 | 10/1990 |
| DE | 4025624 | 2/1991 |
| DE | 19540608 | 5/1997 |
| DE | 19757679 | 7/1998 |
| DE | 19736982 | 8/1998 |
| EP | 59695 | 9/1982 |
| EP | 269435 | 6/1988 |
| EP | 0 882 496 A2 | 12/1998 |
| EP | 0995483 A1 | 4/2000 |
| HU | 41652 | 5/1987 |
| JP | 56076233 | 6/1981 |
| JP | 09032084 | 2/1997 |
| JP | 09032085 | 2/1997 |
| JP | 09041466 | 2/1997 |
| JP | 09057081 | 3/1997 |
| JP | 09195364 | 7/1997 |
| JP | 09277913 | 10/1997 |
| JP | 10124746 | 5/1998 |
| JP | 11286980 | 10/1999 |
| JP | 11299671 | 11/1999 |
| JP | 11330041 | 11/1999 |
| SU | 1691219 | 11/1991 |
| WO | WO 8302761 | 8/1983 |
| WO | WO 9315828 | 8/1993 |
| WO | WO 9739327 | 10/1997 |
| WO | WO 98 09598 | 3/1998 |
| WO | WO 9842786 | 10/1998 |
| WO | WO 2000037770 | 6/2000 |
| WO | WO 2000053346 | 9/2000 |

FLOW-BASED CHEMICAL DISPENSE SYSTEM

RELATED APPLICATIONS

This application claims benefit of priority of U.S. provisional application Serial No. 60/304,587, entitled "Flow-Based Chemical Dispense Control System," filed Jul. 10, 2001, and U.S. provisional application Serial No. 60/312,587, entitled "Fill Station And Application-Based Allocator And Formulator For A Chemical Dispense Control System," filed Aug. 15, 2001. This application is related to subject matter disclosed in U.S. patent application for a "Remote Access To Chemical Dispense System," Ser. No. 10/188,620, filed concurrently herewith, the subject matter of which is incorporated in this application by reference.

TECHNICAL FIELD

The invention relates generally to dispensing a chemical product, and more particularly, to monitoring and controlling formulation of the chemical product.

BACKGROUND OF THE INVENTION

Chemical products composed of various chemical concentrates may be used to clean or sanitize food and beverage production equipment and all associated environmental surfaces in plants that produce food and beverage products. To accomplish this, an on-site formulation system prepares a chemical product by combining one or more component chemical concentrates according to a specialized formula or plan. Conventional formulation systems typically formulate such chemical products from component chemical concentrates in response to instructions that are pre-stored locally on the formulation system.

Conventional formulation systems prepare chemical products using time-based methods to dispense component chemical concentrates to dispense locations wherein the component chemical concentrates combine at the dispense locations to form the chemical products. Such time-based methods for dispensing component chemical concentrates to dispense locations are indirect and may not provide proof of delivery of the component concentrates used to form the chemical products. As such, chemical products formulated by these chemical dispense systems may not be sold to clients on a true per-sale basis. Furthermore, time-based methods may yield inaccurate results if, for example, the supply of a particular component chemical concentrate is used up as the chemical product is being formed at the dispense location.

SUMMARY OF THE INVENTION

In accordance with the present invention, the above and other problems are solved by a flow-based chemical dispense system. Generally, the flow-based chemical dispense system formulates a chemical product using one or more component chemical concentrates. The component chemical concentrates are supplied from concentrate containers to a dispense hose having an outlet valve through which the concentrates are dispensed to the dispense location. The flow of component concentrates between the containers and the dispense hose is monitored by the flow-based chemical dispense system to measure volumetric information associated with each component chemical concentrate used to form the chemical product. The volumetric information is then used by the flow-based chemical dispense system to control formulation of the chemical product. The volumetric information is also analyzed and provided to authorized users—operators and customers—such that the authorized users may monitor various aspects of system operation, such as, without limitation, proof of chemical concentrate delivery.

In accordance with an embodiment, the flow-based chemical dispense system includes a formulator, a fill station operably coupled to the formulator and a flow meter for monitoring flow of component chemical concentrates, i.e., chemical concentrates used to form a particular chemical product, to a dispense location. The dispense location may be either a point-of-use or a storage container, such as a jug situated in the fill station or a drum. In this embodiment, a dispense hose is coupled between the flow meter and the dispense location for direct discharge of the component chemical concentrates to the dispense location. The flow meter senses volumetric information associated with each component chemical concentrate dispensed through the dispense hose to form a specific chemical product.

In further accordance with this embodiment, the flow-based chemical dispense system includes a controller for analyzing the volumetric information sensed by the flow meter. Such an analysis may generate both chemical and account data related to the chemical product as well as each component chemical concentrate of the chemical product. Account data may be provided to authorized users for monitoring ancillary aspects of dispense operations, such as, without limitation, concentrate supply/demand, per-use characteristics, concentrate use relative to a given period of time and chemical product supply/demand. Chemical data may be used by the controller, or alternatively, monitored by an authorized user, for use in controlling chemical product formulation operations as the component concentrates are dispensed through the dispense hose to a dispense location wherein the chemical product is being formed.

In accordance with yet another embodiment, the flow-based chemical dispense system may further include a human-machine interface (HMI) having a graphical user interface (GUI) for facilitating user interaction with the system. In this embodiment, chemical and account data are defined using a web "front-end" function, and are transferred via a file system through a universal communicator to the HMI. The universal communicator is coupled to the HMI thereby providing two-way data transfer from the HMI/GUI to and from a corporate server. As such, an embodiment of the present invention may be a client-server based computer architecture for dispensing component chemical concentrates to form a chemical product using a flow-based control system.

The computer architecture includes communication means for receiving data associated with the chemical product and the component chemical concentrates. This data may be, for example, chemical data or account data. As the component chemical concentrates are dispensed to the dispense location, feedback control is administered by the dispense control system as the control system receives measured volumetric information associated with the chemical product via a flow meter. By providing remote access to chemical data, the communication means enables a user to oversee formulation operations from a remote location thereby monitoring whether the chemical product is being formed with the proper chemical concentrates and the component chemical concentrates are being injected at the proper volumetric flow rate. By providing access to account data, the communication means allows for management control over the business and account aspects of chemical dispensing operations, such as, without limitation, inventory replenishment and monitoring of invoice-related matters.

Embodiments of the invention may be implemented as a computer process, a computing system or as an article of manufacture such as a computer program storage product or computer readable media. The computer program storage product may be a computer storage media readable by a computer system and encoding a computer program of instructions for formulating a chemical product using one or more component chemical concentrates. The computer program storage product may also be a propagated signal on a carrier readable by a computing system and encoding a computer program of instructions for executing a computer process.

The great utility of the invention is formulation of a chemical product is monitored and controlled by a flow-based control system. As such, accurate proof of delivery of a given volume of component chemical concentrates allows the formulated chemical products to be sold using a conventional per-sale basis. Furthermore, chemical products may be more accurately formulated as flow-related information is provided back to the system during component concentrate dispensing, which typically occurs simultaneous to product formulation. These and various other features as well as advantages, which characterize the present invention, will be apparent from a reading of the following detailed description and a review of the associated drawings.

DETAILED DESCRIPTION

Figure 1:
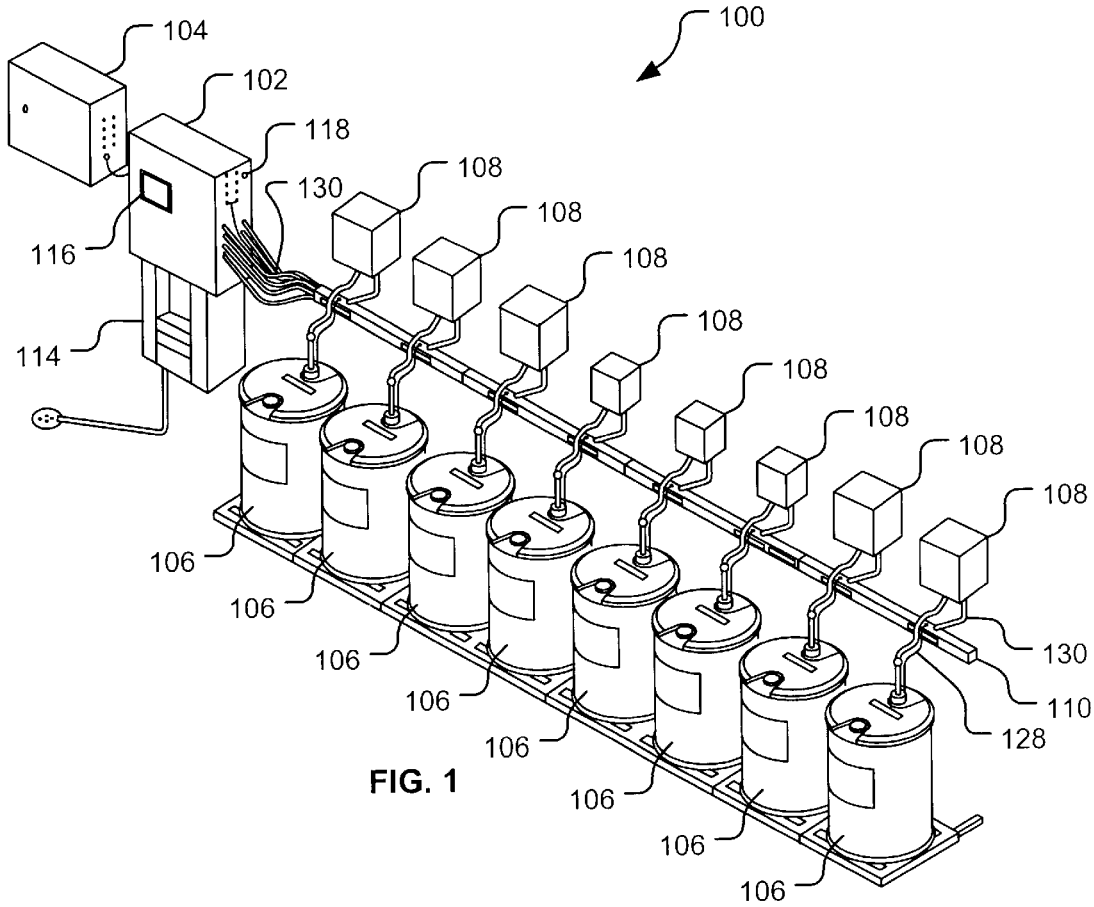
FIG. 1 is a functional diagram of a chemical dispense system in accordance with an embodiment of the present invention and the associated environment.

The present invention and its various embodiments are described in detail below with reference to the figures. When referring to the figures, like structures and elements shown throughout are indicated with like reference numerals.

Referring to FIG. 1, a conceptual illustration of an embodiment of the present invention is shown. FIG. 1 shows a chemical dispense system 100 for dispensing chemical concentrates to a dispense location for formulation of a chemical product at the dispense location in accordance with an embodiment of the present invention. Although the dispense location is hereafter described as a storage location, the dispense location may be any container or reservoir operable to hold a chemical product. Moreover, the dispense location may be a point-of-use, which is a location where the chemical product may be used to accomplish a desired task, such as, without limitation, cleaning, filling, rinsing or otherwise utilizing.

The chemical dispense system 100 formulates, i.e., prepares according to a specialized formula, a chemical product using a plurality of component chemical concentrates by dispensing the component chemical concentrates to the storage location. The storage location may be defined as a drum, a jug, a tote or a bulk tank. If dispensed into a jug, the chemical product is thereafter stored for transfer to a point-of-use where the chemical product is used to perform a desired task. If dispensed into a drum, the chemical product is thereafter stored for allocation, i.e., distribution according to a specified plan, by an allocator 104.

In accordance with an embodiment, the allocator 104 may be programmed to distribute the chemical product to a jug at a predetermined time or during a particular sequence wherein a plurality of chemical products are distributed to a jug. Alternatively, the allocator 104 may be programmed to distribute the chemical product to a particular point-of-use at a predetermined time or during a predetermined distribution sequence wherein a plurality of chemical products are distributed to the point-of-use.

In accordance with an embodiment, the chemical dispense system 100 includes a formulator 102, concentrate pumps 108, and a fill station 114. In accordance with an embodiment, the formulator 102 includes a human-machine interface (HMI) (not shown) through which a user may input instructions related to formulation of a specific chemical product. The HMI includes a graphical user interface (GUI), such as a touch-screen interface 116, operating on a Microsoft Windows CE™-based operating system. Other than the touch-screen interface 116, the HMI may include any other conventional GUI through which a user may input instructions for monitoring and/or controlling operations of the chemical dispense system 100.

Based on user instructions, the formulator 102 formulates requested chemical products by combining water and/or one or more component chemical concentrates in a jug situated in the fill station 114. Water may be input to the formulator 102 through a water inlet 118. The term "chemical concentrate" refers to both water and all other chemical concentrates used by the formulator 102 in formulating a chemical product. As described above, rather than being combined in a jug, the component chemical concentrates may also be combined in a drum, tote or bulk tank.

Prior to being supplied to the formulator 102, the chemical concentrates are stored in concentrate containers 106. Because the chemical concentrates are ultimately used to form various chemical products, the term "component" chemical concentrate(s) is used herein to refer to one or more specific chemical concentrate(s) used by the chemical dispense system 100 to form a chemical product. The formulator 102 controls operation of the concentrate pumps 108, which extract the chemical concentrates stored in the concentrate containers 106 and supply pressure to push or pass the chemical concentrates through concentrate conduits 130 to a manifold (not shown in FIG. 1; 212 in FIG. 2) located inside the formulator 102. More specifically, based on user instructions, the formulator 102 selects one or more concentrate pumps 108, one at a time in a preprogrammed sequence, for activation in accordance with an embodiment of the present invention.

Each concentrate pump 108 is associated with a specific chemical concentrate stored in a specific concentrate container 106. Each concentrate pump 108 is attached to an associated concentrate container 106 via a container-pump connection 128. The container-pump connection shown in FIG. 1 as a pipe 128 may be any form of pipe, conduit or hose.

Upon activation to supply a stored chemical concentrate to the manifold, the concentrate pump 108 transfers the chemical concentrate from the concentrate container 106 to the pump 108 through the pipe 128. The pump 108 funnels each chemical concentrate from the pipe 128 to the manifold via a pump-manifold connection 130, which may be any form of pipe, conduit or hose. In accordance with an embodiment, the manifold connects to eight pump-manifold connections 130, and thus, eight different chemical concentrates may be supplied to the manifold in turn. Alternatively, the manifold may connect to any number of pump-manifold connections 130, and thus, receive any number of concentrates in turn. For clarity, the pump-manifold connection 130 is hereinafter referred to as a concentrate conduit.

Chemical concentrates are discharged from the formulator 102 to the dispense location through the manifold. A dispense hose (not shown in FIG. 1; 218 in FIG. 2) for directing the chemical concentrates from the formulator 102 to the dispense location may be operably connected to an output of the manifold. In accordance with an embodiment, a flow meter (not shown in FIG. 1; 202 in FIG. 2) is coupled between the output of the manifold and the dispense hose. The flow meter measures the volume of flow of each chemical concentrate used to form a particular chemical product through the dispense hose. With this information, the chemical dispense system 100 monitors and controls various dispensing aspects of each component chemical concentrate, such as, but not limited to, the flow rate of each component chemical concentrate between the manifold and the dispense hose and the percentage of each component chemical concentrate of which the chemical product is composed. In addition, the flow meter provides a means for detecting fault with the various mechanical parts of the chemical dispense system 100 if the expected chemical product is not being properly formulated. The flow meter is described in greater detail with respect to FIG. 2.

In accordance with an embodiment, the lower portion of the formulator 102 may be coupled to the fill station 114. The fill station 114 is sized to include a jug for receiving the chemical concentrates as the concentrates are dispensed from the formulator 102 to the fill station 114. As such, the dispense hose protrudes into the jug. The jug may be any size, but in accordance with various embodiments, is a 1.5-gallonjug, a 2.5-gallon jug or a 5-gallon jug. A second dispense hose (not shown) is affixed to a second output of the manifold 102. The second dispense hose may be used to fill drums with specific chemical products formulated by the formulator 102. Alternatively, the formulator 102 may have only a single dispense hose, as described above, wherein the dispense hose may be positioned to fill either a jug situated in the filling station 114 or a drum with a specific chemical product.

Figure 2:
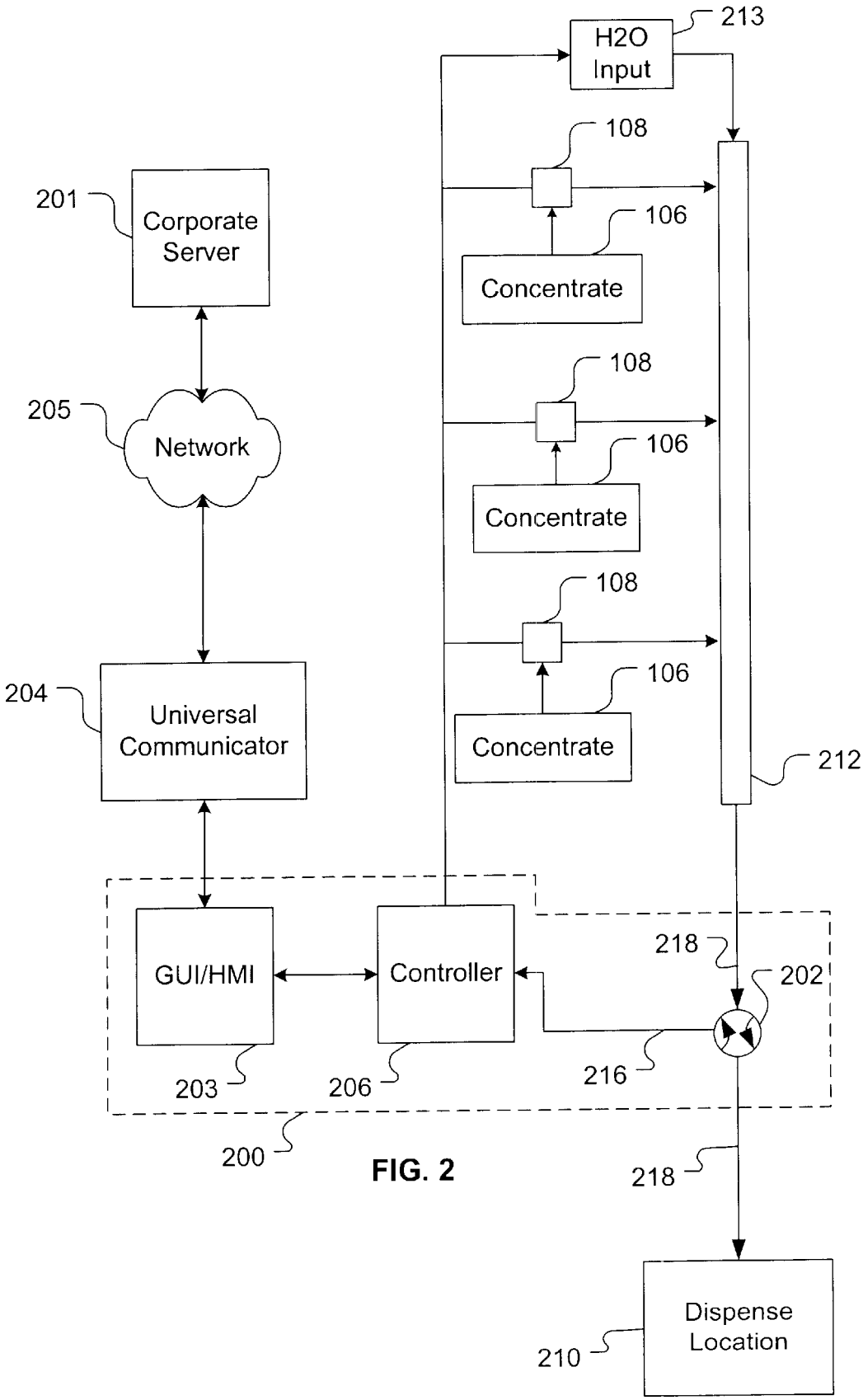
FIG. 2 is a simplified block diagram that illustrates functional components of the chemical dispense system shown in FIG. 1 in accordance with an embodiment of the present invention.

Referring now to FIG. 2, a dispense control system 200 for controlling operations of the chemical dispense system 100 is shown in accordance with an embodiment of the present invention. The dispense control system 200 includes a flow meter 202, a controller 206 and an HMI 203. The controller 206 may be, for example, a PLC or any CPU-based controller. The flow meter 202 detects the flow volume of each chemical concentrate that flows through the flow meter 202 and provides sensed volumetric information to the controller 206.

Generally, a flow meter, such as 202, is a device for measuring flow in any pipe, conduit or hose. A typical flow meter consists of a propeller mounted in a short section of pipe and geared to a revolution counter that provides feedback to the CPU controller. The revolution counter counts revolutions of the turning propeller as one or more chemical concentrates pass through the meter 202. The flow meter 202 then generates a pulse for each turn of the propeller. These pulses are input to a high-speed counter of the controller 206. The controller 206 utilizes the counter to determine the flow in Gallons or Cubic Feet from the received pulses. The controller 206 calculates volume of each concentrate based on the number of pulses the controller 206 receives from the feedback control loop 216. Although the flow meter 202 is described herein as a positive displacement/propeller meter, other types of flow meters may be used without departing from the essence of the present invention. Examples of other types of flow meters include, without limitation, a vortex-based flow meter, a magnetic-based flow meter, an electro-magnetic-based flow meter, a paddle wheel-based flow meter, a coriolis mass-based flow meter and a turbine-based flow meter.

Because the various component concentrates for each chemical product each have different specific gravities, the flow meter 202 is calibrated for each component concentrate. In calibrating the flow meter 202, a given volume of each component concentrate is dispensed through the meter 202. Flow of this given volume generates pulses that are transmitted to the controller 206. After a predetermined number of pulses corresponding to the volume of the component concentrate has been received by the controller 206, the flow of the component concentrate is stopped. The volume of concentrate received is then compared to the volume of concentrate expected, the difference of which renders a flow, or calibration, factor (K-factor) for the component concentrate. The flow factor is used during formulation operations to adjust the number of expected flow pulses so that the volume of the component concentrate required to formulate the chemical product equals the amount of that component concentrate dispensed to the dispense location 210.

Chemical concentrates flow through the flow meter 202 and are dispensed to a dispense location 210 via a dispense hose 218. The chemical product is formed after all component concentrates have exited the hose 218 at the dispense location 210. In accordance with an embodiment, the dispense location 210 maybe a jug situated in a filling station 114, as shown and described with reference to FIG. 1, or a drum (not shown). Alternatively, the chemical dispense system 100 may dispense the chemical concentrates directly to a point-of-use. Under such circumstances, the chemical concentrators are fed via the dispense hose 218 such that the concentrates exit the hose 218 and are provided directly to the point-of use.

A point-of-use may be defined as a physical location where a chemical product is to be formed. For example, a point-of-use may be a utility device, wherein the chemical concentrates are dispensed in turn to clean the device or components of the device. Thus, the chemical product is considered "formed" on the device.

In accordance with one embodiment, the point-of-use may be associated with a food production and/or packaging process and the formulated chemical product may be used to sanitize the food as the food is passing through the production and/or packaging process. Additionally, the point-of-use may be associated with a production and/or packaging process related to manufacture and/or packaging of any tangible good or product. In accordance with still other embodiments, the point-of-use may be associated with an industrial device requiring chemical and/or fluid input, such as a ware-washer, a laundry machine, a vending machine, a keg regulator or any other industrial device of which chemical/fluid flow and insertion is regulated.

Each concentrate pump 108 is operably connected to a chemical concentrate container 106 and is responsible for extracting the chemical concentrate from the container 106 and providing the concentrate to a manifold 212 located inside the formulator 102. In accordance with an embodiment, each respective chemical concentrate is supplied to the formulator 102 via concentrate conduits 130 (FIG. 1) that are coupled to the manifold 212. The concentrates exit the manifold 212 and flow through the flow meter 202 en route to the dispense location 210 via the dispense hose 218. The flow meter 202 measures a volume of each chemical concentrate that flows between the manifold 212 and the dispense hose 218. This measured volumetric information is provided to the controller 206 through a feedback control loop 216. The controller 206 uses this information to regulate the volumetric flow of chemical concentrates into the manifold 212, thereby controlling formulation of each chemical product dispensed by the system 100.

As noted above, formulated chemical products are made up of a set of component concentrates. The specific gravity of the formulated chemical product and the weight percent of the component concentrates required to formulate the chemical product are used to dispense the appropriate volume of each component concentrate to the dispense location 210. After the flow meter 202 has been calibrated for each component used to formulate a specific chemical product, the volume of each component concentrate passed through the flow meter 202 is monitored by the controller 206 to control, i.e., increase, decrease or stop, the flow of the concentrate based on a predetermined volume as required for the formulated chemical product.

In accordance with an embodiment, the measured volumetric information is stored in a production log, thereby providing proof of delivery not only for the chemical product, but also for each respective component chemical concentrate used in forming the product. The controller 206 may also use the measured information to control other aspects related to chemical product formulation at the dispense location 210. For example, without limitation, the dispense control system 200 may use the measured information to monitor and control the velocity of chemical concentrates through the dispense hose 218. Further, the dispense control system 200 may also use the measured information to monitor inventory levels on a supply vessel. When the inventory levels are low, a notification for inventory replenishment is generated which instructs authorized users or an inventory management system that replenishment of a particular chemical concentrate may be needed.

To allow data file transfer to and from the chemical dispense system 100, the dispense control system 200 is coupled to a universal communicator 204. The universal communicator 204 is designed to allow an authorized user to communicate with the HMI 203 through a corporate server 201 such that an authorized user can remotely define chemical applications, user access rights and rules, and other system-related functions for control of the chemical dispense system 100. These functions are defined via the Internet or other network connection 205, and transmitted via a file system through the universal communicator 204 to the dispense control system 100. The universal communicator 204 passes data to and from a corporate server 201 via the network connection 205. The network connection 205 may be established through a modem, a local area network, a wireless network or any other means for connecting to a remote computer.

In accordance with an embodiment, the controller 206 may be a PLC (programmable logic controller) operable to provide hardened I/O (inputs/outputs) for the dispense control system 200. The HMI 203, which provides user control over the chemical dispense system 100, includes a touch screen interface based on the Windows CE operating system in accordance with an embodiment of the present invention. The HMI/GUI 203 may communicate to/from the PLC 206 via data tag sharing and manipulation.

The corporate server 201, which resides at a remote location with respect to the site of the HMI 203 and the controller 206, includes a web-based server application program in accordance with an embodiment of the present invention. Initially, the web-based server application program allows a user to set up his/her system, i.e. configure formulation; create user IDs and Passwords; create applications that are specific for the user's system, etc. When the setup is finished for the user, the web-based server application program will save the information entered into various files, and store such information on the corporate server 201. The files are downloaded onto the controller 206 once the controller 206 contacts the server 201. The files populate the controller 206 with instructions related to specific chemical products that may be formulated by the user's system 100.

As component chemical concentrates are dispensed to the dispense location 210, the controller 206 uses a high-speed counter to monitor flow of the component concentrates through the flow meter 202. Information associated with the flow of the component concentrates through the flow meter 202 is used by the controller 206 to control formulation of the chemical product and provide the HMI 203 with information associated with the chemical product being formulated. The user can access this information on the HMI 203.

The HMI 203 stores every function performed on it to a log file. The log file is sent daily to the corporate server 201 via the universal communicator 204. At the same time that the log file is sent to the corporate server 201, the universal communicator 204 downloads the setup file for the system 100 stored on the server 201 thereby retrieving the updated files in order to update formulation, user or dispense application information accordingly.

Figure 3A:
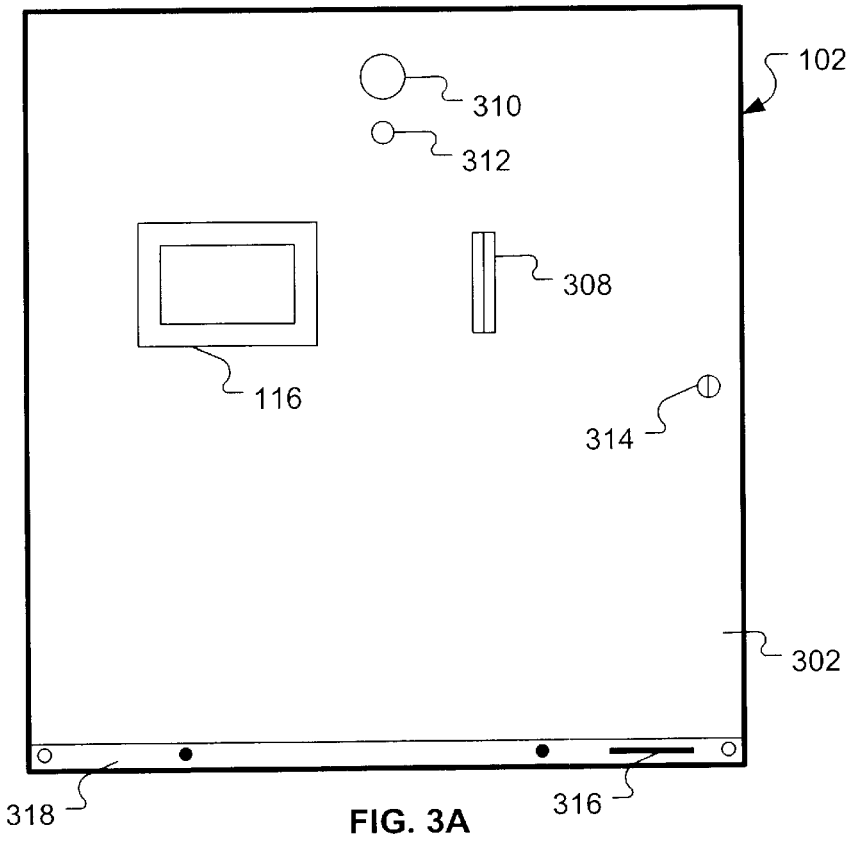
FIGS. 3A, 3B and 3C show alternative views of a formulator of the chemical dispense system shown in FIG. 1 in accordance with an embodiment of the present invention.
Figure 3B:
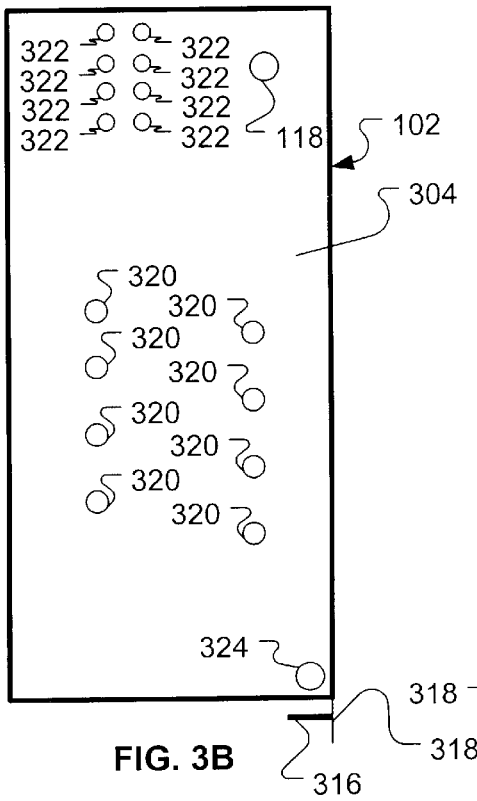
Figure 3C:
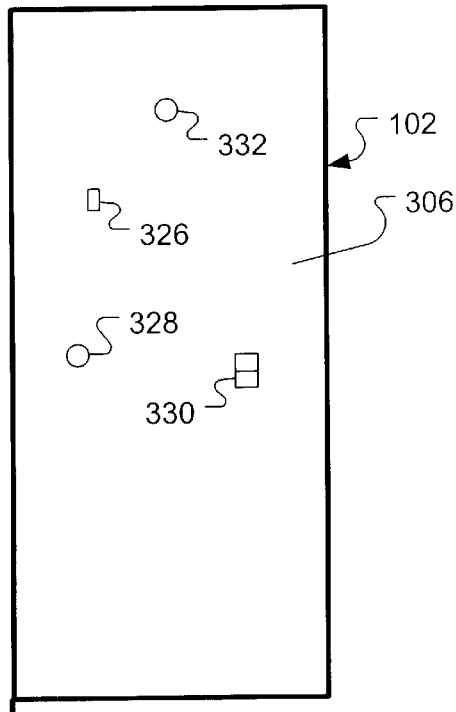

Referring to FIGS. 3A, 3B and 3C, front and side views of the formulator 102 are shown in accordance with an embodiment of the present invention. Specifically, the front view of the formulator is shown in FIG. 3A with the formulator 102 having a front cover 302, a side view is shown in FIG. 3B with the formulator 102 having a first side cover 304 and an opposite side view is shown in FIG. 3C with the formulator 102 having a second side cover 306.

Referring to FIG. 3A, the formulator 102 includes an HMI 203 (FIG. 2) having a touch screen interface 116 through which a GUI is presented, a card reader 308, a system active indicator 312, an emergency stop button 310, a lock 314, an air regulator mounting bracket 316 and a fill station mounting tab 318. The HMI 203 provides each authorized user with the ability to operate and control the chemical dispense system 100. Because the HMI 203 has a touch screen interface 116 on the formulator 102, the authorized user may operate and control the system 100 as the user is located on-site with the system 100. An authorized user is a person who has been setup on the server with a user ID and password to access the HMI 203. He/She can access the program by entering his/her user ID and password.

The card reader 308 provides another way of access to the HMI 203 such that an authorized user can operate and control the chemical dispense system 100. As such, a potential user desiring access to the chemical dispense system 100 may swipe an access card through the card reader 308 to gain such access. The HMI 203 performs identification and authentication procedures based on information stored on the access card. If the potential user is identified and authenticated as an authorized user to the chemical dispense system 100, access to the system 100 is granted thereby enabling the user to operate and control the system 100 through the GUI presented on the touch screen interface 116.

The system active indicator 312 displays the status of the chemical dispense system 100. For example, if the formulator 102 is formulating a chemical product, the system active indicator indicates such by a predetermined signal. The signal may be a flashing or static light of a certain color in accordance with an embodiment. Furthermore, the signal may be a digital representation associated with some characteristic of the chemical product being formulated.

The emergency stop button 310 provides a "kill switch" for the chemical dispense system 100. In case of emergencies, the emergency stop button 310 can be pressed to halt operation of the system 100. The air regulator mounting bracket 316 provides support for an air regulator used in the formulation process of the chemical dispense system 100. Likewise, the fill station mounting tab 318 provides the connection that enables the fill station 114 to be mounted on the base of the formulator 102.

Referring to FIG. 3B, the formulator 102 further includes a plurality of concentrate inlets 320 and a plurality of drum probe connectors 322 in accordance with an embodiment of the present invention. Each concentrate inlet 320 connects to a concentrate conduit 130 thereby receiving chemical concentrates carried by the conduits 130 (FIG. 1). The drum probe connectors 322 connect drum probe conduits (not shown) to the formulator 102, and thus to the control system 200. The drum probe conduits are oppositely coupled to drum probes situated in each container that measure the level of concentrate currently stored in each container. The drum probes generate drum level signals indicating the level of concentrate contained in each concentrate container 106.

The drum probe connectors 322 establish a communication path between the concentrate pumps 108 and the controller 206 (FIG. 2) of the control system 200, thereby enabling the controller 206 to monitor which pump(s) is/are activated at a given point in time. The controller 206 is also enabled to activate and de-activate the concentrate pumps 108 via the drum probe connectors 322. In accordance with an embodiment, each drum probe generates a drum level signal if the concentrate level in the concentrate container 106 monitored by the drum probe is low. Such a "low" drum level signal alerts the controller 206 that the concentrate levels are low, and that the pump 108 coupled to the corresponding container 106 should be turned off. Furthermore, the controller 206 may reduce the flow of the concentrate from a container 106 if the drum level signal indicates low concentrate levels in the container 106 and/or alert an authorized user that the concentrate container 106 needs replenishing. In accordance with another embodiment, a drum probe may constantly transmit drum level signals indicating concentrate levels, regardless of whether the container 106 is low in concentrate. Such a "constant" level signal may be used to continuously monitor usage of the concentrate contained in the container 106.

Referring to FIG. 3C, the formulator 102 is shown having a power receptacle 328, a data communication terminal 326, a power switch 330 and an alarm 332 in accordance with an embodiment of the present invention. Power is supplied to the formulator 102 through the power receptacle 328. That is, the formulator 102 may be turned on and off by toggling the power switch 330. The data communication terminal 326 enables the chemical dispense system 100 to be connected to a client-server network. The data communication terminal 326 may be a phone jack, Ethernet port, wireless transmission means, a dedicated communication line or any other conventional networking port or device operable to allow a remote server to communicate with the chemical dispense system 100. The alarm 332 alerts users that a component, either hardware or software, of the chemical dispense system 100 is malfunctioning.

The alarm 332 may also be configured to alert users that a particular concentrate level is below a predetermined level in accordance with an alternative embodiment of the present invention. The controller 206 and other computer architecture internal to the chemical dispense system 100 constantly monitor components of the system 100 to ensure that the system 100 is operating properly. For example, if the chemical dispense system 100 is formulating a chemical product and a concentrate pump 108 fails, the controller 206 will detect null or inadequate flow of the concentrate from the concentrate pump 108 and, as a result, initiate the alarm 332. In accordance with an embodiment, the alarm 332 is an immediate page to either an authorized user or sales associate of the account associated with the particular system 100. As noted above, the alarm 332 may be activated under other circumstances, such as, without limitation, communication failures, preventive maintenance or low product.

Figure 4:
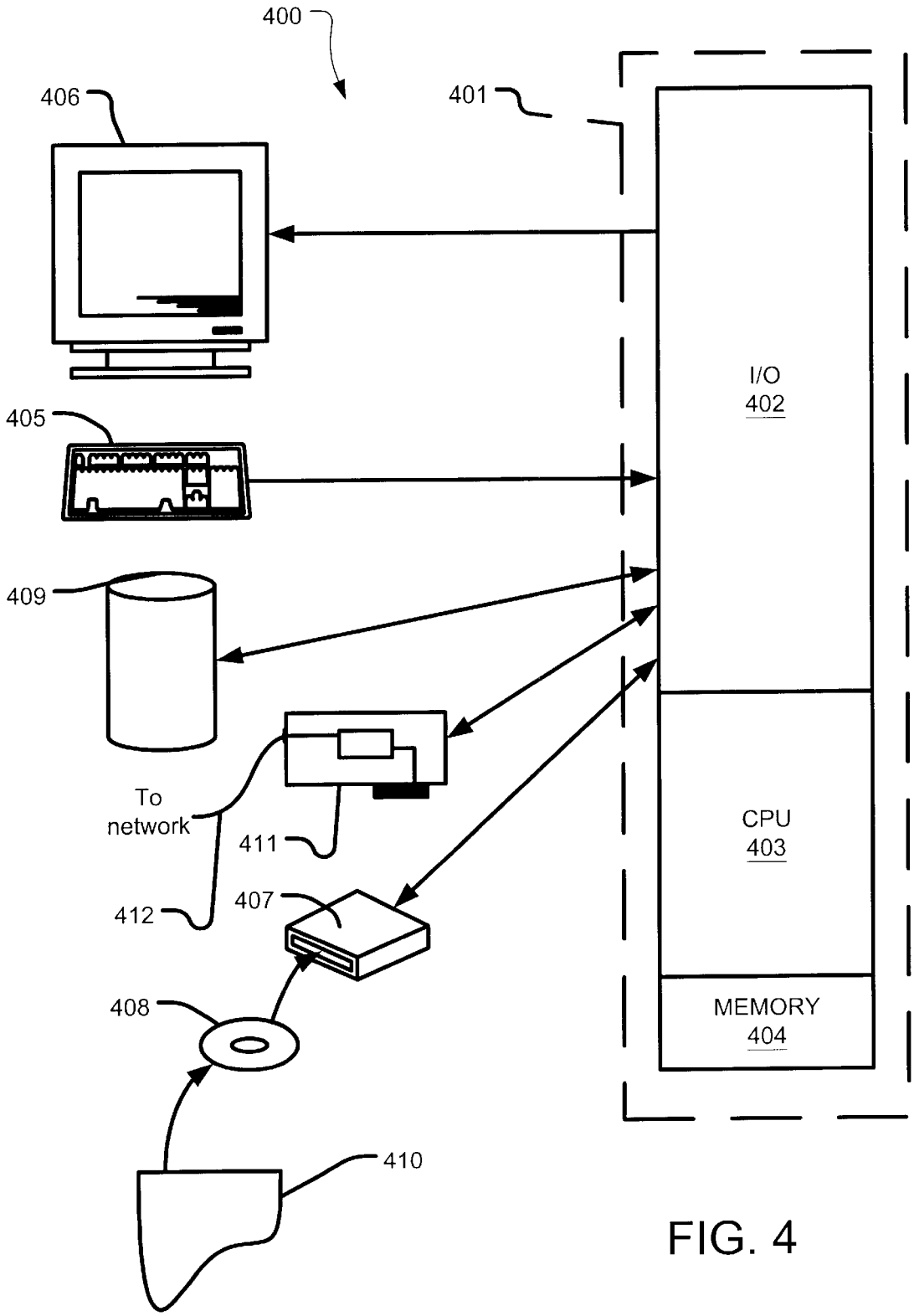
FIG. 4 depicts a block diagram of a suitable computing environment in which an embodiment of the present invention may be implemented.

In accordance with one embodiment, the dispense control system 200 may be implemented as a computing system including at least some form of computer program storage or communication medium readable by a computing system and encoding a computer program for formulating a chemical product using one or more chemical concentrates. FIG. 4 and the following discussion are intended to provide a brief, general description of a suitable computing environment in which an embodiment of the present invention may be implemented. Although not required, embodiments of the present invention will be described in the general context of computer-executable instructions, such as program modules, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in concurrent, multi-tasking computing environments wherein tasks are performed by remote processing devices that are linked through a communications network. In concurrent, multi-tasking computing environments, program modules may reside in both local and remote memory storage devices.

FIG. 4 depicts a general-purpose computing system 400 capable of executing a program product embodiment of the present invention. One operating environment in which the present invention is potentially useful encompasses the general-purpose computing system 400. In such a system, data and program files may be input to the computing system 400, which reads the files and executes the programs therein. Some of the elements of a general-purpose computing system 400 are shown in FIG. 4 wherein a processor 401 is shown having an input/output (I/O) section 402, a Central Processing Unit (CPU) 403, and a memory section 404. The present invention is optionally implemented in software devices loaded in memory 404 and/or stored on a configured CD-ROM 408 or storage unit 409 thereby transforming the computing system 400 to a special purpose machine for implementing the present invention.

The I/O section 402 is connected to a keyboard 405, a display unit 406, a disk storage unit 409, and a disk drive unit 407. In accordance with one embodiment, the disk drive unit 407 is a CD-ROM driver unit capable of reading the CD-ROM medium 408, which typically contains programs 410 and data. Computer program products containing mechanisms to effectuate the systems and methods in accordance with the present invention may reside in the memory section 404, the disk storage unit 409, or the CD-ROM medium 408 of such a system. In accordance with an alternative embodiment, the disk drive unit 407 may be replaced or supplemented by a floppy drive unit, a tape drive unit, or other storage medium drive unit. A network adapter 411 is capable of connecting the computing system 400 to a network of remote computers via a network link 412. Examples of such systems include SPARC systems offered by Sun Microsystems, Inc., personal computers offered by IBM Corporation and by other manufacturers of IBM-compatible personal computers, and other systems running a UNIX-based or other operating system. A remote computer may be a desktop computer, a server, a router, a network PC (personal computer), a peer device or other common network node, and typically includes many or all of the elements described above relative to the computing system 400. Logical connections may include a local area network (LAN) or a wide area network (WAN). Such networking environments are commonplace in offices, enterprise-wide computer networks, intranets, and the Internet.

In accordance with a program product embodiment of the present invention, software instructions, such as instructions directed toward communicating data between a client and a server, detecting product usage data, analyzing data, and generating reports, may be executed by the CPU 403; and data, such as products usage data, corporate data, and supplemental data generated from product usage data or input from other sources, may be stored in memory section 404, or on the disk storage unit 409, the disk drive unit 407 or other storage medium units coupled to the system 400.

As is familiar to those skilled in the art, the computing system 400 further comprises an operating system and usually one or more application programs. The operating system comprises a set of programs that control operations of the computing system 400 and allocation of resources. The set of programs, inclusive of certain utility programs, also provide a graphical user interface to the user. An application program is software that runs on top of the operating system software and uses computer resources made available through the operating system to perform application specific tasks desired by the user. In accordance with an embodiment, the operating system may employ a graphical user interface wherein the display output of an application program is presented in a rectangular area on the screen of the display device 406. The operating system is operable to multitask, i.e., execute computing tasks in multiple threads, and thus may be any of the following: Microsoft Corporation's "WINDOWS 95," "WINDOWS CE," "WINDOWS 98," "WINDOWS 4000" or "WINDOWS NT" operating systems, IBM's OS/2 WARP, Apple's MACINTOSH SYSTEM 8 operating system, X-windows, etc.

In accordance with the practices of persons skilled in the art of computer programming, the present invention is described below with reference to acts and symbolic representations of operations that are performed by the computing system 400, a separate storage controller or a separate tape drive (not shown), unless indicated otherwise. Such acts and operations are sometimes referred to as being computer-executed. It will be appreciated that the acts and symbolically represented operations include the manipulations by the CPU 403 of electrical signals representing data bits causing a transformation or reduction of the electrical signal representation, and the maintenance of data bits at memory locations in the memory 404, the configured CD-ROM 408 or the storage unit 409 to thereby reconfigure or otherwise alter the operation of the computing system 400, as well as other processing signals. The memory locations where data bits are maintained are physical locations that have particular electrical, magnetic, or optical properties corresponding to the data bits.

The logical operations of the various embodiments of the present invention are implemented (1) as a sequence of computer-implemented steps running on a computing system 400 and/or (2) as interconnected machine modules within the computing system 400. The implementation is a matter of choice dependent on the performance requirements of the computing system 400 implementing the invention. Accordingly, the logical operations making up the embodiments of the present invention described herein are referred to alternatively as operations, acts, steps or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

Figure 5:
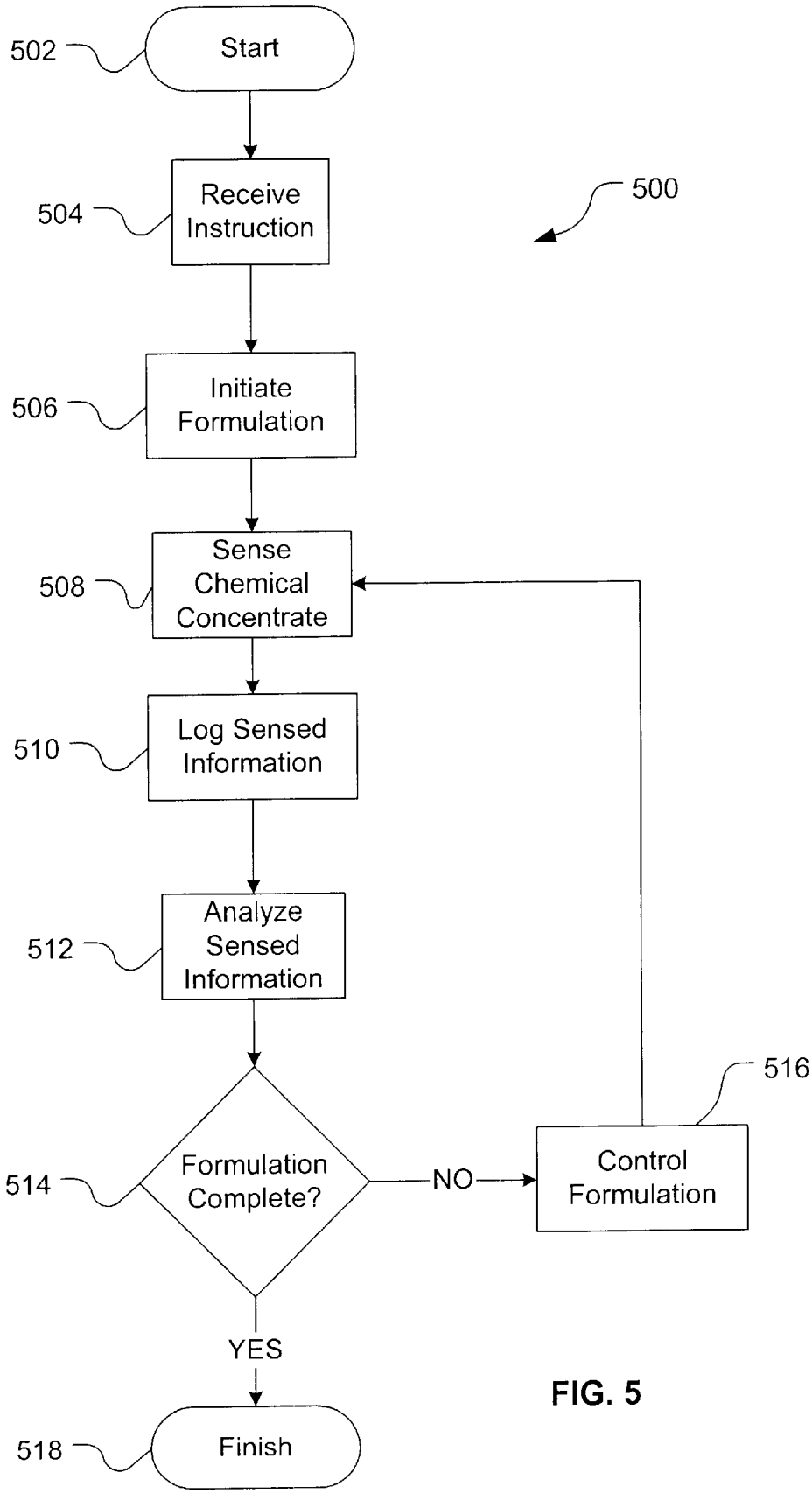
FIG. 5 is a flow diagram that illustrates operational characteristics for formulating a chemical product in accordance with an embodiment of the present invention.

Referring to FIG. 5, a chemical product formulation process 500 generally illustrating operations for formulating a chemical product using one or more component chemical concentrates is shown in accordance with an embodiment of the present invention. The formulation process 500 is performed by an operation flow beginning with a start operation 502 and concluding with a terminate operation 518. For simplicity, the chemical product formulation process 500 is described below as formulating a single chemical product. However, the control system 200 may be used to simultaneously or sequentially formulate multiple chemical products.

The operation flow begins at the start operation 502 and continues to a receive instruction operation 504. The receive instruction operation 504 receives an instruction to formulate a specific chemical product from an authorized user interacting with the HMI 203. The operation flow then passes to an initiate formulation operation 506, which initiates formulation of the chemical product identified in the received instruction. In accordance with an embodiment, the initiate formulation operation 506 sequentially activates concentrate pumps 108 associated with the chemical concentrates used to form the chemical product (hereinafter, "component chemical concentrates"). Each of the component chemical concentrates are therefore provided to the formulator 102 in step-by-step, or sequential, fashion (i.e., one component concentrate at a time). The concentrate pumps 108 are thus activated in turn to supply the component chemical concentrates to the concentrate conduits 130, which then carry each component concentrate to the formulator 102. In accordance with an alternative embodiment, the initiate formulation operation 506 activates the appropriate concentrate pumps 106 simultaneously such that each component chemical concentrate is provided through a concentrate conduit to the formulator 102 at the same time.

Following the initiate formulation operation 506, the operation flow passes to a monitor operation 508. The monitor operation 508 monitors, senses or measures the flow of component chemical concentrates passing through a manifold 212 located inside the formulator 102. The component chemical concentrates flow from the manifold 212 to a dispense hose 218 that dispenses each component concentrate to a dispense location 210. Various forms of information are monitored, sensed or measured by the monitor operation 508, such as, without limitation, the chemical composition of the chemical product being formulated using the concentrates, the percent volume, mass or weight of each chemical concentrate used in forming the chemical product and the volume of flow i.e., volume per unit of time, of each chemical concentrate passing between the manifold 212 and the dispense hose 218 at a given point in time. After this information is monitored, sensed or measured, the operation flow passes to a log information operation 510.

The log information operation 510 divides the sensed information samples based on specific concentrate categories and stores each sample to a concentrate category record. The concentrate category records are used to provide system users with the information sensed by the monitor operation 508. The log information operation 510 may further divide the sensed information samples into information category records of each concentrate category record. The information category records identify a specific information category to which each sample relates. For example, one sample associated with volume or percent weight of a particular component chemical concentrate may be separated or identified from another sample associated with the specific gravity of the same component chemical concentrates. As such, each sample is identified with a distinct information category record.

In accordance with an embodiment, the log information operation 510 calculates the actual percent volume, mass or weight of each component concentrate passing between the manifold 212 and the dispense hose 218 at different points in time during product formulation. Specifically, as samples are received and divided into concentrate category records and further into information category records, information related to the actual volume of each concentrate dispensed through the dispense hose 218 is combined with like information from previous samples. From the log information operation 510, the operation flow passes to an analyze information operation 512.

The analyze operation 512 analyzes the measured information associated with each component chemical concentrate provided to the formulator 102, and thus analyzes information associated with the formulated chemical product. As noted above, the measured information is logged or stored in concentrate category records. For each chemical product formulated, there are two forms of data that may result from the analysis performed by the analyze operation 512: chemical data and account data. Generally, chemical data is defined as any data associated with actual formulation of a chemical product. In accordance with an exemplary embodiment, chemical data relates to information associated with concentrate composition (specific gravity) and volume of flow of each component chemical concentrate through the dispense hose 218. For instance, the analyze operation 512 determines an actual weight percent for each component concentrate currently being dispensed to the dispense location 210, i.e., jug or drum, to form the requested chemical product. Each weight percent represents percent volume of a single component concentrate currently situated in a jug or drum relative to the other component concentrates in the jug or drum. The weight percent is calculated by multiplying the specific gravity of the component concentrate against the actual volume of the component concentrate that has been passed through the dispense hose 218.

In accordance with an embodiment of the present invention, account data is generally defined as any data other than chemical data. Specifically, account data relates to information associated with business and supply characteristics of the chemical products and component concentrates. For instance, the analyze operation 512 may determine the amount of each component concentrate of a particular chemical product for a customer in order to render a per-sale price for the chemical product that is to be charged to the customer. Additionally, the analyze operation 512 may also track the quantity of a particular chemical product formulated for a customer in order to accurately fill the customer's order for a specified quantity of the product. Data generated by analyze information operation 512 identifying such a determination is thus defined as account data. The operation flow then passes from the analyze operation 512 to a query operation 514.

The query operation 514 determines whether the chemical product formulation is complete by comparing the actual volume of each component chemical concentrate dispensed to the dispense location against a predetermined volume required by each component concentrate in order to form the chemical product. That is, the query operation 514 compares the weight percent of each component concentrate to an expected weight percent associated with each component concentrate to determine whether the chemical product is being formed with the proper volume of each component concentrate.

If the query operation 514 determines that product formulation is not complete, the operation flow passes to a control formulation operation 516. The control formulation operation 516 controls formulation of the chemical product based on one or more analyses performed by an analyze operation 512. For instance, if of the query operation 514 determines that the chemical product is deficient in chemical mass with respect to a particular component concentrate, the control formulation operation 516 controls the concentrate pump 108 associated with that component concentrate such that a greater volume of component concentrate is supplied to the formulator 102. If the query operation 514 determines that product formulation is complete, the operation flow concludes at a terminate operation 518.

Figure 6:
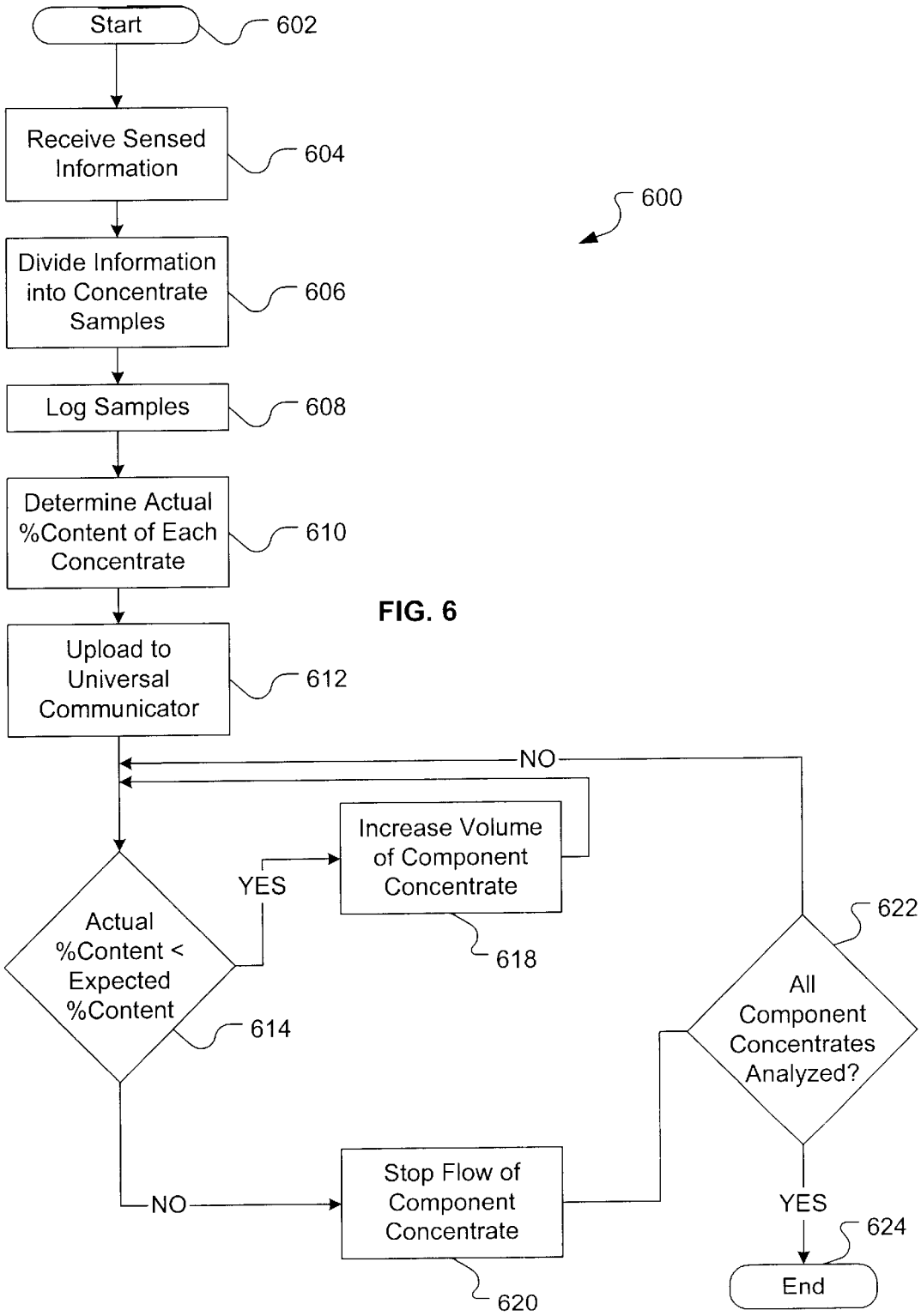
FIG. 6 is a flow diagram that illustrates operational characteristics for monitoring and controlling formulation of a chemical product in accordance with an embodiment of the present invention.

FIG. 6 illustrates operations performed by the control system 200 as the system 200 receives volumetric information associated with each component chemical concentrate used to form a chemical product and thereafter processes the volumetric information to monitor and control formulation of the chemical product in accordance with an embodiment of the present invention. Specifically, a process 600 generally illustrating operations for monitoring and controlling formulation of a chemical product is shown comprising an operation flow beginning with a start operation 602 and concluding with a terminate operation 624. For simplicity, the monitor/control process 600 is described below as monitoring and controlling formulation of a single chemical product. However, the formulation process 600 may be used to simultaneously monitor and control formulation of multiple chemical products.

The operation flow begins at the start operation 602 and continues to a receive operation 604. The receive operation 604 receives various forms of measured information associated with the chemical product being formulated. In accordance with an embodiment, the measured information is volumetric information associated with each component chemical concentrate used in forming the chemical product. As the sensed information is received, the operation flow passes to a divide operation 606.

The divide operation 606 separates the sensed information into concentrate samples, with each concentrate sample being associated with a specific component chemical concentrate of the chemical product. As such, each sample may be assigned to a concentrate category. Because the component concentrates are provided to the formulator 102 in sequential, and not simultaneous, fashion in accordance with an embodiment, the divide operation 606 assigns each concentrate sample into a specific concentrate category based on which concentrate pump 108 is activated as the sample is sensed from the component chemical concentrate. In accordance with an alternative embodiment wherein the component concentrates are provided to the formulator 102 in simultaneous fashion, each component concentrate is monitored by the monitor operation 606 prior to being combined in the formulator 102. After the information is divided into samples identified by a specific component concentrate, the operation flow passes to a log operation 608.

The log operation 608 further divides the sensed information samples associated with concentrate categories into information categories. The information categories identify a specific monitored aspect of the component chemical concentrate to which each sample relates. For example, one sample associated with volume/weight percent of a component chemical concentrate may be divided from another sample associated with alkalinity of the component chemical concentrate, with each sample being identified using a particular information category. As such, one sample may be identified using a weight percent category, the other using an alkalinity category. The log operation 608 may also store the samples in concentrate category records and further into concentrate information records, based on concentrate and information categories, respectfully. By storing information samples in records, the information may be readily uploaded for monitoring and controlling as described in greater detail below. The operation flow passes from the log operation 608 to a determination operation 610.

The determination operation 610 calculates the actual percent volume, mass or weight of each component chemical concentrate used in formulating the chemical product at different points in time wherein the chemical product, currently being formulated, is filling up in a jug or a drum. At the conclusion of formulation, the chemical product may be considered "formed." As samples are received and divided into concentrate category records and further into information category records, information related to the actual volume of each concentrate dispensed to a dispense location 210 is combined with like information from previous samples to generate a current weight percent of each component concentrate currently forming the product. Each current weight percent represents percent volume based on specific gravity of a component chemical concentrate forming the collection of component concentrates currently situated in the jug or the drum. As such, the current weight percent of one component chemical concentrate is measured relative to all other component chemical concentrates situated in the jug or drum. From the determination operation 610, the operation flow passes to an upload operation 612.

The upload operation 612 uploads data to the HMI 203 thereby allowing access to the information by authorized users. As described earlier, the information may be analyzed and presented as account data and/or chemical data. An authorized user may access the HMI 203 locally, or alternatively, remotely via the universal communicator 204. By uploading the data to the HMI 203, an authorized user may monitor the formulation of the chemical product and is provided information such as, without limitation, proof of delivery of a concentrate to the chemical product. The operation flow passes from the upload information 612 to a first query operation 614.

The first query operation 614 is a repetitive analysis that is repeated for each component chemical concentrate used in formulating the chemical product. Thus, on an initial pass, the first query operation 614 determines whether the current weight percent for a first component chemical concentrate is less than an expected weight percent for that component chemical concentrate in the formed chemical product.

If the current weight percent of the component chemical concentrate currently being analyzed is less than the expected weight percent, the operation flow passes to an increase volume operation 618. The increase volume operation 618 maintains the flow of that component chemical concentrate from the associated concentrate container 106 to the manifold 212. In accordance with an embodiment, the increase volume operation 618 may increase the rate of flow that the component concentrate is pulled from the associated concentrate container 106 to the manifold 212. From the increase volume operation 618, the operation flow passes back to the first query operation 614. The operation flow then passes between the first query operation 614 and the increase volume operation 618 until the current weight percent of the component chemical concentrate currently being analyzed is greater than or equal to the expected weight percent of that component chemical concentrate. Once the current weight percent is greater than or equal to, i.e., not less than, the expected weight percent, the operation flow passes to a stop flow operation 620. The stop flow operation 620 stops pulling the first component chemical concentrate from the associated concentrate container 106 to the manifold 212.

Following the stop operation 620, the operation flow passes to a second query operation 622. The second query operation 622 determines whether the current weight percent of each component chemical concentrate forming that chemical product has been analyzed against an expected weight percent. If each component chemical concentrate has not been analyzed, the operation flow passes back to the first query operation 614 and continues as described above. The operation flow thus repeats the first query operation 614, the second query operation 622, the increase volume operation 618 and the stop flow operation 620 for each of the component chemical concentrates making up the chemical product. After all the component chemical concentrates used in forming the chemical product are analyzed, the operation flow concludes with the terminate operation 624.

It will be clear that the present invention is well adapted to attain the ends and advantages mentioned, as well as those inherent therein. While a presently preferred embodiment has been described for purposes of this disclosure, various changes and modifications may be made which are well within the scope of the present invention. For example, a flow meter, such as the flow meter 202 shown in FIG. 2 and described in the associated text, may be operably coupled to each of the concentrate containers 106 in order to provide volumetric information acquired at the point of dispense for each component chemical concentrate to the controller 206. Such an implementation enables the component chemical concentrates to be simultaneously provided to the manifold 212, rather than in sequential fashion. As such, the component concentrates are combined within the manifold 212 and provided to the flow meter 202 and the dispense hose 218 as a combination of component chemical concentrates. Each flow meter measures, senses and monitors the component chemical concentrates as described above. The chemical product is thus considered formulated after the proper volume of each concentrate, i.e., the volume required of each concentrate to form the chemical product, has been dispensed out of the dispense hose and to the dispense location 210. Numerous other changes may be made which will readily suggest themselves to those skilled in the art and which are encompassed in the spirit of the invention disclosed and as defined in the appended claims.

What is claimed is:

1. A chemical dispense system for forming a chemical product at a dispense location comprising:

a formulator formulating the chemical product using a plurality of component chemical concentrates;

a flow meter operably connected between the formulator and a dispense hose dispensing the component chemical concentrates to the dispense location, the flow meter monitoring the component chemical concentrates flowing through the dispense hose and measuring volumetric information associated with each component chemical concentrate;

a flow controller analyzing the volumetric information generated by the flow meter and controlling a volume of each component chemical concentrate dispensed to the dispense location; and a human-machine interface receiving the volumetric information measured by the flow meter and presenting the volumetric information on a graphical user interface through which an authorized user may interact with the human machine interface to monitor operations of the formulator.

2. A chemical dispense system as defined in claim 1, wherein the volumetric information received by the human-machine interface is in the form of account data associated with each of the plurality of component chemical concentrates dispensed to the dispense location.

3. A chemical dispense system as defined in claim 2, wherein the account data relate to financial information associated with a balance due on the volume of each of the component chemical concentrates dispensed to the dispense location.

4. A chemical dispense system as defined in claim 1, wherein the volumetric information received by the human-machine interface is in the form of chemical data associated with each of the plurality of component chemical concentrates dispensed to the dispense location.

5. A chemical dispense system as defined in claim 1 wherein the human-machine interface is a component of the formulator such that the authorized user may control the chemical dispense system through instructions input to the formulator.

6. A chemical dispense system as defined in claim 1 further comprising:

a universal communicator connecting the human-machine interface to a corporate server over a network connection such that the dispensing operations on the system may be manipulated and defined from a remote location.

7. A chemical dispense system as defined in claim 1, further comprising:

a plurality of concentrate pumps, each concentrate pump being associated with one of the plurality of component chemical concentrates and extracting an associated component chemical concentrate from a concentrate container upon receiving an instruction transmitted from the formulator.

8. A chemical dispense system as defined in claim 1, wherein the dispense location is a jug situated in a fill station.

9. A chemical dispense system as defined in claim 1, wherein the dispense location is a drum.

10. A chemical dispense system for forming a chemical product at a dispense location comprising:

a formulator formulating the chemical product using a plurality of component chemical concentrates;

a flow meter operably connected between the formulator and a dispense hose dispensing the component chemical concentrates to the dispense location, the flow meter monitoring the component chemical concentrates flowing through the dispense hose and measuring volumetric information associated with each component chemical concentrate; and a flow controller analyzing the volumetric information generated by the flow meter and controlling a volume of each component chemical concentrate dispensed to the dispense location, wherein the controller the volumetric information relates to a current weight percent of a component chemical concentrate relative to one or more other component chemical concentrates at the dispense location at a given point in time, the controller analyzing the weight percent against an expected weight percent to regulate the volume of the component chemical concentrate flowing through the dispense hose such that the chemical product is formed at the dispense location with a predetermined weight percent of the component chemical concentrate.

11. A chemical dispense system as defined in claim 10, wherein the controller increases the volume of the component chemical concentrate flowing through the dispense hose if the current weight percent is less than the expected weight percent.

12. A chemical dispense system as defined in claim 10, wherein the controller stops flow of component chemical concentrate through the dispense hose if the current weight percent is greater than the expected weight percent.

13. A method for forming a chemical product at a dispense location, the method comprising:

transferring a component chemical concentrate from a concentrate container to a manifold;

passing the component chemical concentrate from the manifold through a dispense hose to the dispense location;

sensing the component chemical concentrate flowing between the manifold and the dispense hose to measure volumetric information associated with the component chemical concentrate;

analyzing the volumetric information to render a current weight percent of the component chemical concentrate dispensed to the dispense location;

controlling flow of the component chemical concentrate to the dispense location such that the chemical product is formed with a predetermined weight percent of the component chemical concentrate; and logging the volumetric information in records such that proof of delivery of a volume of the component chemical concentrate dispensed to the dispense location is recorded.

14. A method as defined in claim 13 further comprising:

analyzing the volumetric information logged in the records to generate account data associated with the component chemical concentrate.

15. A method as defined in claim 14, wherein the account data relates to financial information associated with a balance due on the volume of the component chemical concentrate dispensed to the dispense location.

16. A method as defined in claim 13, wherein the current weight percent of the component chemical concentrate is taken relative to one or more other component chemical concentrates dispensed to the dispense location at a given point in time and the analyzing act comprises:

comparing the current weight percent to an expected weight percent at the given point in time.

17. A method as defined in claim 16, wherein the controlling act comprises:

regulating flow of the component chemical concentrate to the dispense location such that the chemical product is formed with the predetermined percent weight of the component chemical concentrate.

18. A method as defined in claim 17, wherein the regulating act comprises:

maintaining flow the component chemical concentrate to the dispense location if the current weight percent is less than the expected weight percent.

19. A method as defined in claim 17, wherein the regulating act comprises:

stopping flow of the component chemical concentrate between concentrate container and the manifold if the current weight percent is greater than or equal to the expected weight percent.

20. A method as defined in claim 13, wherein the dispense location is a jug situated in a fill station.

21. A method as defined in claim 13, wherein the dispense location is a drum.

22. A method as defined in claim 13, wherein the acts of transferring, passing, sensing, analyzing and controlling the chemical concentrate volume are simultaneously performed for a plurality of component chemical concentrates.

23. A method for forming a chemical product at a dispense location by dispensing a plurality of component chemical concentrates to the dispense location through a dispense hose, wherein the method comprises, monitoring each component chemical concentrate flowing through the dispense hose to calculate a current weight percent of each component chemical concentrate based on a calibrated flow factor associated with each component concentrate, wherein the calibrated flow factor takes into account specific gravity of each component concentrate; and controlling a volume of each component chemical concentrate flowing through the dispense hose such that the chemical product is formed having a predetermined weight percent of each component chemical concentrate.

24. A method as defined in claim 23, wherein the controlling act comprises:

comparing the current weight percent of each component concentrate to the predetermined weight percent associated with each component concentrate.

25. A method as defined in claim 24, wherein the regulating act comprises:

increasing the volume of a specific component chemical concentrate flowing through the dispense hose if the current weight percent of the specific component chemical concentrate is less than the predetermined weight percent associated with the specific component chemical concentrate.

26. A method as defined in claim 24, wherein the regulating act comprises:

stopping flow of a specific component chemical concentrate through the dispense hose if the current weight percent of the specific component chemical concentrate is greater than or equal to the predetermined weight percent associated with the specific component chemical concentrate.

27. A computer program storage medium readable by a computing system and encoding a computer program for executing a computer process for forming a chemical product at a dispense location, the computer process comprising:

transferring a component chemical concentrate from a concentrate container to a manifold;

passing the component chemical concentrate from the manifold through a dispense hose to the dispense location;

sensing the component chemical concentrate flowing through the dispense hose to measure volumetric information associated with the component chemical concentrate;

analyzing the volumetric information to render a current weight percent of the component chemical concentrate dispensed to the dispense location;

controlling flow of the component chemical concentrate to the dispense location such that the chemical product is formed with a predetermined weight percent of the component chemical concentrate; and logging the volumetric information in records such that proof of delivery of a volume of the component chemical concentrate dispensed to the dispense location is recorded.

28. A computer program storage medium as defined in claim 27, wherein the computer process further comprises:

analyzing the volumetric information logged in the records to generate account data associated with the component chemical concentrate.

29. A computer program storage medium as defined in claim 28, wherein the account data relates to financial information associated with a balance due on the volume of the component chemical concentrate dispensed to the dispense location.

30. A computer program storage medium as defined in claim 27, wherein the current weight percent of the component chemical concentrate is taken relative to one or more other component chemical concentrates to the dispense location at a given point in time and the analyzing act comprises:

comparing the current weight percent to an expected weight percent at the given point in time.

31. A computer program storage medium as defined in claim 30, wherein the controlling act comprises:

regulating the volume of the component chemical concentrate dispensed to the dispense location such that the chemical product is formed having the predetermined percent weight of the component chemical concentrate.

32. A computer program storage medium as defined in claim 31, wherein the regulating act comprises:

maintaining flow of the component chemical concentrate flowing to the dispense location if the current weight percent is less than the expected weight percent.

33. A computer program storage medium as defined in claim 31, wherein the regulating act comprises:

stopping flow of the component chemical concentrate to the dispense location if the current weight percent is greater than the expected weight percent.

* * * * *